US010366683B2

(12) United States Patent
Iio et al.

(10) Patent No.: US 10,366,683 B2
(45) Date of Patent: Jul. 30, 2019

(54) PERCUSSION INSTRUMENT PLAYING DEVICE

(71) Applicant: UTSUWA INC., Kyoto-shi, Kyoto (JP)

(72) Inventors: Hideaki Iio, Kyoto (JP); Yuki Tsujimoto, Kyoto (JP); Masato Miyake, Kyoto (JP); Tomoya Mikuma, Kyoto (JP); Kosuke Miyaki, Kyoto (JP)

(73) Assignee: UTSUWA INC., Kyoto (JP)

( * ) Notice: Subject to any disclaimer, the term of this patent is extended or adjusted under 35 U.S.C. 154(b) by 0 days.

(21) Appl. No.: 15/756,230

(22) PCT Filed: Jun. 26, 2017

(86) PCT No.: PCT/JP2017/023439
§ 371 (c)(1),
(2) Date: Feb. 28, 2018

(87) PCT Pub. No.: WO2018/105157
PCT Pub. Date: Jun. 14, 2018

(65) Prior Publication Data

US 2019/0027123 A1 Jan. 24, 2019

(30) Foreign Application Priority Data

Dec. 9, 2016 (JP) ..... 2016-006258

(51) Int. Cl.
*G10H 1/00* (2006.01)
*G10D 13/02* (2006.01)
*G10D 13/00* (2006.01)
*G10F 1/08* (2006.01)

(52) U.S. Cl.
CPC ..... *G10H 1/0008* (2013.01); *G10D 13/00* (2013.01); *G10D 13/003* (2013.01); *G10D 13/024* (2013.01); *G10F 1/08* (2013.01)

(58) Field of Classification Search
CPC .... G10H 1/0008; G10D 13/00; G10D 13/003; G10D 13/024; G10F 1/08
See application file for complete search history.

(56) References Cited

U.S. PATENT DOCUMENTS 8,884,145 B1 * 11/2014 Lin ..... G10D 13/02 84/422.1

* cited by examiner

*Primary Examiner* — Kimberley R Lockett
(74) *Attorney, Agent, or Firm* — Oliff PLC

(57) ABSTRACT

A percussion-instrument playing apparatus for playing a percussion instrument having a striking surface. The apparatus includes: a main body to be mounted on the percussion instrument 100 to face the striking surface of the percussion instrument with a predetermined space from the striking surface; an arm supporter attached to the main body; an arm that has, at a distal end, an arm head, and is rotatably supported by the arm supporter; a drive device that allows the arm to be rotationally displaced between a state where the arm head pushes the striking surface of the percussion instrument and a state where the arm head is separated from the striking surface; a control device that controls the drive device in accordance with a control program; and an operation device that outputs a drive instruction signal to the control device in response to an operation by a user.

17 Claims, 10 Drawing Sheets

PERCUSSION INSTRUMENT PLAYING DEVICE

TECHNICAL FIELD

The present invention relates to a percussion-instrument playing apparatus for playing a percussion instrument having a striking surface.

BACKGROUND ART

Various instrument-playing apparatuses have been conventionally provided for the purpose of simultaneous play of multiple instruments by a single player. For example, Patent Literatures 1 and 2 disclose apparatuses for playing a cajon that is one type of percussion instrument. The cajon is an instrument which includes a rectangular-parallelepiped hollow box made of wood. The cajon has: the front surface serving as a striking surface, the backside of which strings and bells are attached to; and the rear surface to which a circular aperture called a sound hole is provided. A player sits down on the upper surface of the cajon placed on the floor, and plays the cajon by slapping the front surface (upper surface or side surfaces, depending on the situation) with one or both hands. The cajon can generate various percussive tones, such as a bass sound and snare sound, depending on the portions of the striking surface to be tapped. In addition, the cajon can easily be carried. Accordingly, the cajon has been widely used as an instrument in place of a drum set, not only for performances in indoor- and outdoor-performance institutions, but also for open-air performances.

The playing apparatuses disclosed in Patent Literatures 1 and 2 both include a foot pedal disposed in a lower portion of the front surface of a cajon, and a beater attached to the foot pedal. A player steps on the foot pedal, causing the beater to strike the striking surface of the cajon in conjunction with the player's stepping. Accordingly, the cajon is played. Thus, the player can play the cajon with his/her foot, and can also play other instruments with his/her hands, at the same time.

In the aforementioned playing apparatuses, the intensity, timing, and number of times stepping on the foot pedal by a player directly determines the intensity, timing, and number of times of the striking of the striking surface of the cajon by the beater. Accordingly, it is difficult for these playing apparatuses to play a fast-paced number and an arrhythmic number even at a slow-pace. Thus, there have been limitations on the possible range of expressions for rhythmic sounds.

This problem is not limited to the cajon mentioned earlier as one example of the percussion instrument. Any instruments played by being struck on their striking surfaces, such as a drum (drum set), a conga drum, a bongo drum, a hand drum, or a Japanese drum, have similar problems.

CITATION LIST

Patent Literature

Patent Literature 1: Japanese Utility Model Registration No. 3158678

Patent Literature 2: Japanese Unexamined Patent Application Publication No. 2016-118596

SUMMARY OF INVENTION

Technical Problem

The problem to be solved by the present invention is to allow a percussion instrument having a striking surface to be freely and easily played.

Solution to Problem

A percussion-instrument playing apparatus according to an aspect of the present invention includes: a main body detachably fixed in front of or above a percussion instrument having, in a front surface or an upper surface, a striking surface; an arm having one end fixed to the main body via an arm supporter, and an arm head detachably fixed to the other end of the arm. The arm is driven under electronic control and includes one or more arms, and the arm head of each of the one or more arms strikes the same striking surface of the percussion instrument to emit sounds.

A percussion-instrument playing apparatus according to another aspect of the present invention is for use in playing a percussion instrument having a striking surface. The apparatus includes:

a) a main body to be mounted on the percussion instrument to face the striking surface of the percussion instrument with a predetermined space from the striking surface;

b) an arm supporter fixed to the main body;

c) an arm that has, at a distal end, an arm head, and is rotatably supported by the arm supporter;

d) a drive device that allows the arm to be rotationally displaced between a state where the arm head pushes the striking surface and a state where the arm head is separated from the striking surface;

e) a control device that controls the drive device based on a control program; and f) an operation device that outputs a drive instruction signal to the control device in response to an operation by a user.

Advantageous Effects of the Invention

According to the present invention, a percussion instrument having a striking surface can be freely and easily played.

DESCRIPTION OF EMBODIMENTS

Figure 1A:
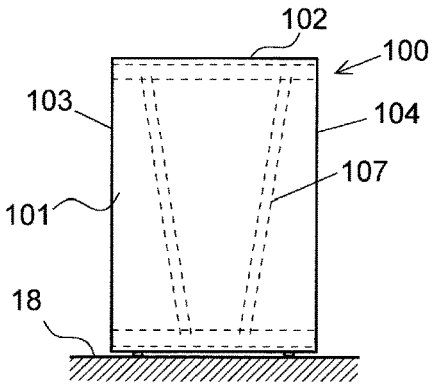
FIG. 1A is a front view of a cajon that is an example of percussion instruments for which a percussion-instrument playing apparatus according to the present invention can be used.

A percussion-instrument playing apparatus according to the present invention is used for playing percussion instruments by striking a striking surface. Such percussion instruments are exemplified by a cajon having a striking surface on the front surface or the upper surface, or a cajon having three or four striking surfaces in total including two surfaces out of the right side surface, left side surface, and the rear surface, in addition to the upper surface and/or the front surface. In addition, the percussion-instrument playing apparatus can be used for a drum (drum set), a conga drum, a bongo drum, a hand drum, or a Japanese drum, which have a striking surface on the upper or front surface. As mentioned above, the percussion-instrument playing apparatus according to the present invention is typically used for percussion instruments having a striking surface on at least one of the side surfaces (including a front surface) or an upper surface. Here, the percussion-instrument playing apparatus can also be used for instruments having a surface usable as the striking surface, in addition to the percussion instruments. Such instruments include pianos, guitars, and violins, for example. Furthermore, the percussion-instrument playing apparatus can also be used for tools, materials, etc., which are not used as instruments in a normal situation, to provide a performance. For example, those tools may be cooking utensils (e.g. dishes, pans, or pots) or furniture (e.g. drawers or tables). Those materials may be plates (e.g. wooden boards or iron plates), empty cans, or glass bottles.

The percussion-instrument playing apparatus according to an aspect of the present invention includes: a main body detachably fixed in front of or above a percussion instrument having, in a front surface or an upper surface, a striking surface; an arm having one end fixed to the main body via an arm supporter, and an arm head detachably fixed to the other end of the arm. The arms are driven under electronic control and the arm heads of the arms strike the same striking surface of the percussion instrument to emit sounds.

The percussion-instrument playing apparatus according to another aspect of the present invention includes:

a) a main body to be mounted on the percussion instrument to face the striking surface of the percussion instrument with a predetermined space from the striking surface;

b) an arm supporter attached to the main body;

c) an arm that has, at a distal end, an arm head, and is rotatably supported by the arm supporter;

d) a drive device that allows the arm to be rotationally displaced between a state where the arm head pushes the striking surface and a state where the arm head is separated from the striking surface;

e) a control device that controls the drive device based on a control program; and f) an operation device that outputs a drive instruction signal to the control device in response to an operation by a user.

When the percussion-instrument playing apparatus is used, the main body is mounted on the percussion instrument in a manner of having a predetermined space from a striking surface of the percussion instrument, to face the striking surface. Accordingly, the main body is mounted in front of the striking surface of the percussion instrument when the front surface serves as the striking surface, whereas the main body is mounted above the top surface of the percussion instrument when the top surface of the percussion instrument serves as the striking surface. Areas to be pushed by the arm heads vary depending on the position where the main body is mounted (height position, right and left positions, or front and rear positions). Accordingly, any sounds can be emitted by adjusting the position where the main body is mounted.

The main body may be fixed to the percussion instrument with adhesive, screws, nails, or similar methods. In addition, the main body may include a mounting member for allowing the main body to be detachably mounted on the percussion instrument. With this, the mounting position of the main body can be changed as needed every time the percussion instrument is played.

It is preferable that each of the main body and the arm supporter includes an attachment portion for attaching the arm supporter to the main body, and at least one of the attachment portion of the main body and the attachment portion of the arm supporter is configured so that an attachment position of the arm supporter to the main body can be changed. With this configuration, a position where the arm head strikes the striking surface can be changed. Certain types of percussion instruments emit significantly different tones depending on the struck position of the striking surface. In such percussion instruments, the tones can be adjusted by changing the attachment positions of the arm supporter. For example, a cajon emits a low-pitched sound upon being struck at a center area of its striking surface, and emits a high-pitched sound upon being struck around the corners of its striking surface. In the striking surface, when an area near the portion where the rear surface is strung is struck, the strings sound more loudly in comparison with the area away from the strung portion being struck. The attachment position of the arm supporter to the main body can be changed while the main body is mounted on the percussion instrument.

It is preferable that the arm supporter is detachably attached to the main body. The number of arm supporters attached to the main body is not limited to one, but may be two or more. When a plurality of arm supporters are attached to the main body (i.e., the main body includes a plurality of supporter attachment portions to which the arm supporters can be attached), it is preferable that the drive device includes a plurality of drive units for separately driving the arms each of which is supported by a corresponding one of the plurality of arm supporters. With this configuration, a plurality of portions of the striking surface can be simultaneously struck by a plurality of arm heads, or can be struck at different timings. This configuration may be combined with the aforementioned configuration that the struck portions in the striking surface can be changed, to allow different tones to be emitted by every arm head, and thereby provide a wider variety of tone combinations. Furthermore, while some of the arm heads are kept to push the striking surface, the remaining arm heads can strike the striking surface, thereby widening the variations of tone combinations.

In the aforementioned percussion-instrument playing apparatus, when a user operates an operation device in a state where the main body is mounted on the percussion instrument, a drive-instruction signal is outputted from the operation device; and a control device causes, in response to the drive-instruction signal, the drive device to operate in accordance with a control program. Accordingly, the arm is rotatably displaced, changing the conditions between a state where the arm head pushes the striking surface and a state where the arm head separates from the striking surface (in other words, the arm head strikes the striking surface). The control program may be previously set to cause the drive device to operate in such a manner that the arm heads strike the striking surface with tempo, rhythm, intensity, and other influences that match a musical piece a user wants to perform. With this, the user can play the percussion instrument by only operating the operation device.

The drive device may preferably be provided in the main body or the arm supporter in the aforementioned percussion-instrument playing apparatus. The operation device may be provided in the main body. It is more preferable for the operation device to be provided separately from the main body, and to send and receive signals to and from the control device through wire or wireless connection. It should be noted that the control device is preferably provided in the main body or both of the main body and the operation device. When the operation device is provided separately from the main body, the operation device may be a foot switch. With this configuration, a user can play, with his/her hand, another instrument different from the percussion instrument to which the percussion-instrument playing apparatus according to the present invention is attached.

The operation device and the control device may be configured as a device dedicated to the percussion-instrument playing apparatus. These devices may alternatively be embodied by installing dedicated controlling/processing software into an electronic device, such as a personal computer or a smartphone, and by executing the software in the electronic device. In addition, a portion of the functions of the operation device and the control device may be executable in a remote area by means of an information and communication technology device, such as the Internet.

The playing conditions including the striking intensity, striking tempos, and striking rhythms of the arm heads that strike a striking surface may be changed by an operation of the operation device by a user. This configuration can be embodied, for example, in such a manner that the operation device includes a plurality of operation units for setting the playing conditions, and outputs driving instruction signals containing the playing conditions in response to the operations on these operation units. Such a configuration allows for a performance free from specific musical pieces, such as an ad-lib performance.

It is preferable for the percussion-instrument playing apparatus according to the present invention to include an adjusting member for adjusting the intensity at which the arm head strikes the striking surface. With this configuration, the arm head can strike the striking surface with the intensity set based on the type of percussion instrument, or on the type of musical pieces to be played.

It is preferable for the drive device to include a drive mechanism using an electromagnetic force, such as a solenoid actuator. With this configuration, the intensity at which the arm head strikes the striking surface can be controlled by controlling current to be supplied to the drive device.

At least one of the main body, the arm, and the arm head may include a light emitting device that repeats turning light on and off in response to the timing that the arm head pushes the striking surface. With such a device, the performance of the percussion instrument can be made more beautifully.

The above-mentioned percussion-instrument playing apparatus may further include:

a plurality of types of arm supporters to be detachably attached to the main body, each of the plurality of types of the arm supporters supporting the arm having, at the distal end, the arm head with individual weight; and an arm-information storing section for storing arm information relating to rotational displacement characteristics of the arm supported by a corresponding one of the arm supporters, for the plurality of types of the arm supporters, and the control device may control the drive device in accordance with the control program and the arm information for each of the arms supported by the corresponding arm supporters attached to the main body.

The rotational displacement characteristics of the arm mean the relationship between the magnitude of the force necessary for causing a certain arm to start rotating and the weight of the arm, and the relationship between the quantities of rotational displacement and the weight of the arm upon the same force being applied to the arm. The information relating to the rotational displacement characteristics of the arm means, for example a control pattern of the drive device suitable for each of the arms, which is obtained based on the rotational displacement characteristics.

Embodiments of the present invention are hereinafter described, with reference to the drawings.

Figure 1B:
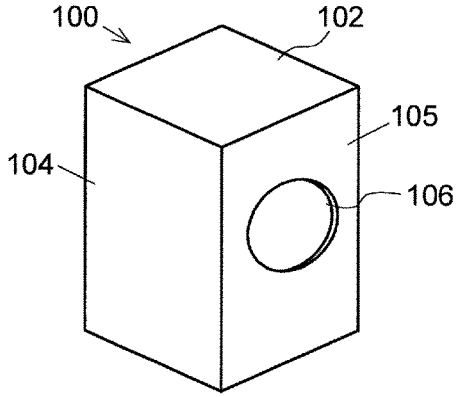
FIG. 1B is a perspective view of the cajon, which is seen from the left-back.

Before the description of a percussion-instrument playing apparatus in each of the embodiments, a cajon as an example of the percussion instruments played by the playing apparatus is described with reference to FIGS. 1A and 1B. Only the cajon will be described as an example of the percussion instrument to be played in the following embodiments. However, as noted earlier, the present invention is not limited to cajon but can be generally applied to or used with percussion instruments having a striking surface, such as a drum (drum set), a conga drum, a bongo drum, a hand drum, or a Japanese drum, as well as other kinds of musical instruments, or even tools or other objects.

A cajon 100 includes a wooden hollow box having a vertically-long rectangular parallelepiped hollow shape. In normal situations, the cajon 100 is directly placed on the floor 18 when played. The cajon 100 has a front surface 101 which is smaller than the other surfaces. The front surface 101 typically serves as a striking surface, although a top surface 102, a left-side surface 103, and a right-side surface 104 can also serve as the striking surface. The cajon 100 shown in FIGS. 1A and 1B has a rear surface 105 on which a circular sound hole 106 is provided. Such a sound hole may be provided in the left-side surface 103 or the right-side surface 104. For example, when the left-side surface 103 is provided with the sound hole, a plurality of strings 107 (four strings in FIG. 1A) are strung behind the front surface 101 inside the cajon 100.

First Embodiment

Figure 2:
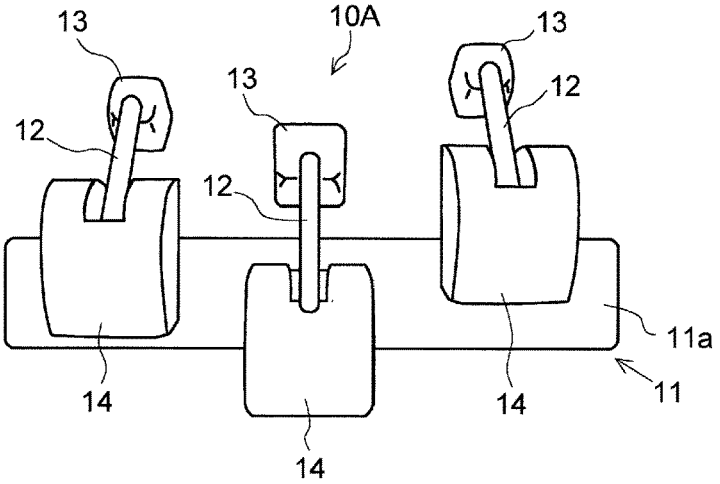
FIG. 2 is a front view of an apparatus main body of the percussion-instrument playing apparatus according to a first embodiment.
Figure 3:
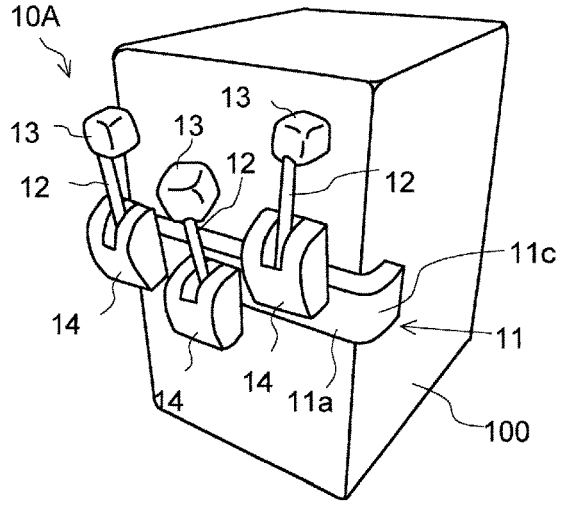
FIG. 3 is a perspective view of the apparatus main body attached to the cajon.
Figure 7:
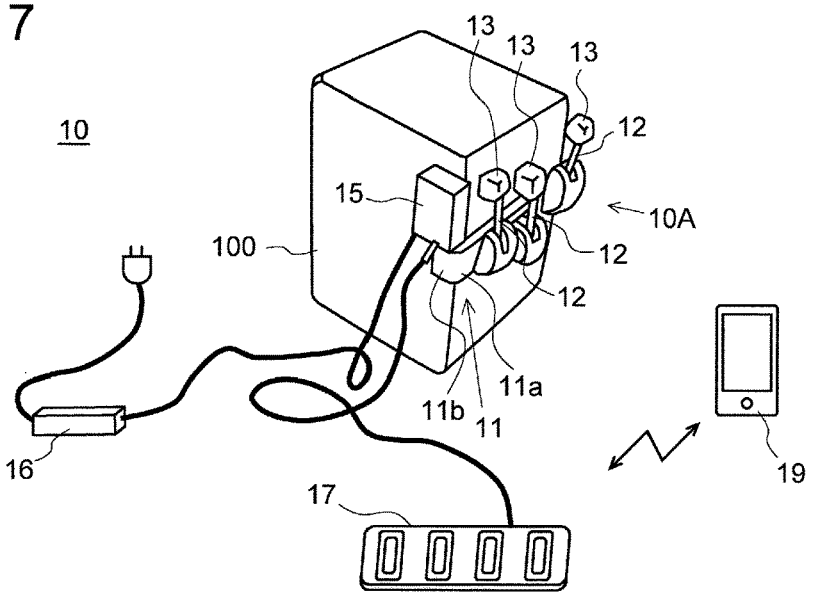
FIG. 7 is a schematic view of the entire structure of the percussion-instrument playing apparatus according to the first embodiment.

FIG. 7 is a schematic view showing the entire structure of a percussion-instrument playing apparatus 10 (hereinafter, referred to as a "playing apparatus" 10) according to the present embodiment. The playing apparatus 10 includes an apparatus main body 10A and an operation device 17. FIG. 2 is a front view showing the apparatus main body 10A. FIG. 3 is a perspective view showing the apparatus main body 10A mounted on the front surface of the cajon 100. As shown in FIGS. 2 and 3, the apparatus main body 10A includes: a main body 11; three arm supporters 14 fixed to the main body 11; arms 12 each of which is roratably attached to the corresponding one of the arm supporters 14; and arm heads 13 each of which is fixed to the corresponding one of the distal ends of the arms 12.

The main body 11 includes: an arm attachment plate 11*a* disposed in front of the striking surface (front surface) of the cajon 100; and holding portions 11*b* and 11*c* each extending toward the rear side from the opposite ends of the arm attachment plate 11*a* (the holding portion 11*b* is shown only in FIG. 7). The distance between the holding portions 11*b* and 11*c* is set to be slightly shorter than the width of the front surface of the 100. The right and left edge portions of the striking surface of the cajon 100 are fitted between the holding portions 11*b* and 11*c*, thereby fixing the main body 11 to the cajon —. The arm attachment plate 11*a* thus fixed has a gap of 1-2 mm from the striking surface of the cajon 100. This can reduce the influence by the main body 11 onto the vibration of the striking surface which occurs the arm heads 13 strike the striking surface of the cajon 100.

Figure 4:
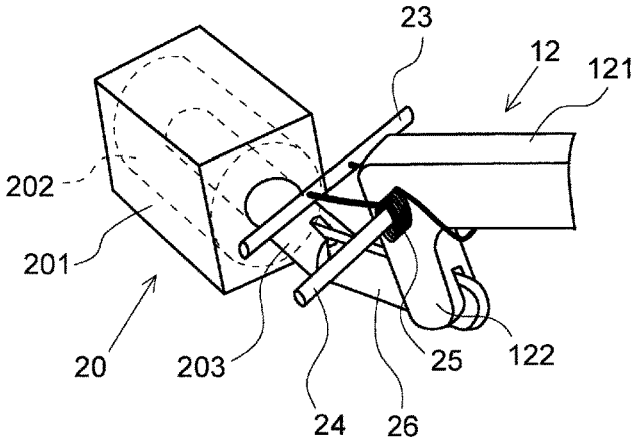
FIG. 4 is a diagram showing a connecting structure connecting a solenoid actuator accommodated in an arm supporter with the proximal end of an arm.

The three arm supporters 14 are fixed to the arm attachment plate 11*a*. Though not shown in detail, those arm supporters 14 are fixed to the arm attachment plate 11*a* with screws. As shown in FIG. 4, each of the arms 12 includes an arm main body 121 disposed outside the arm supporter 14, and an L-shaped proximal end 122 disposed inside the arm supporter 14. The arm head 13 is attached to the distal end of the arm main body 121.

An attachment height of the main body 11 to the cajon 100 may be changed, or the length of the arm 12 may be changed, thereby allowing for a change in the portion at which the arm head 13 strikes the striking surface of the cajon 100. The attachment positions of the arm supporters 14 to the arm attachment plate 11*a* in the horizontal direction and the vertical direction can be appropriately changed. By sliding the attachment positions of the arm supporters 14 in the horizontal direction and the vertical direction of the striking surface of the cajon 100, users can enable the apparatus to emit various drum sounds including high-pitch sounds and low-pitch sounds, as in the case of manually slapping the cajon 100 with both hands.

The arm head 13 can be formed by various materials, such as a natural rubber, synthetic rubber including a silicone rubber or other types of rubber, flexible urethane foam, rigid urethane foam, fiber, wood, bark (cork), or resin. The arm head 13 can have various shapes including a rectangular parallelepiped shape, a column shape, or a sphere shape. Changing the material and the shape of the arm heads 13 leads to a change in the tone and volume of the drum sounds produced by the arm heads 13 striking the cajon 100.

Figure 5:
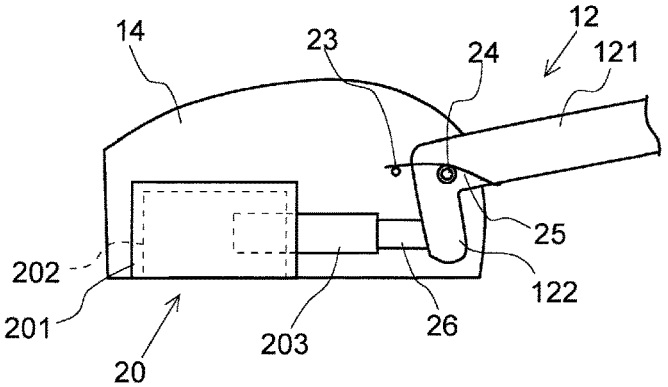
FIG. 5 is a diagram showing an inside structure of the arm supporter when no electromagnetic force is generated in a solenoid coil.
Figure 6:
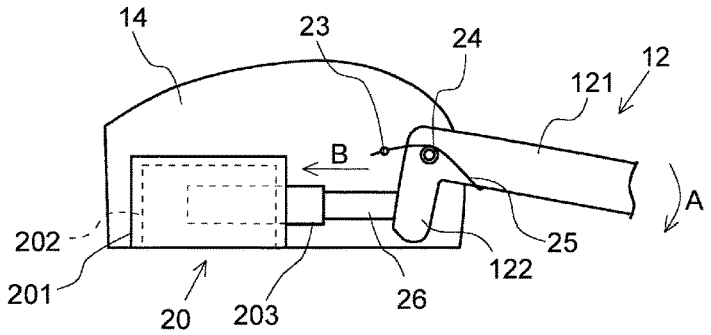
FIG. 6 is a diagram showing the inside structure of the arm supporter when electromagnetic force is generated in the solenoid coil.

As shown in FIGS. 4 to 6, a shaft 24 is fixed to the proximal end 122 of the arm 12. The shaft 24 is rotatably supported by a bearing (not shown) inside each of the arm supporters 14. Inside the arm supporter 14, a spring support axis 23 is fixed in a manner of being approximately in parallel to the shaft 24 supported by the bearing. Two coil sections of a double torsion spring 25 are wound around the shaft 24 on both sides of the proximal end 122. The connecting portion between the two coil sections of the double torsion spring 25 is passed beneath the proximal end 122. Both ends of the double torsion spring 25 are locked by the spring support axis 23. The double torsion spring 25 functions as an adjusting member for adjusting the intensity at which the arm head 13 strikes the striking surface.

The proximal end 122 of the arm 12 is connected to a pull-type solenoid actuator 20 through a joint 26. The solenoid actuator 20 corresponds to the drive device (drive unit) of the present invention. The solenoid actuator 20 includes: a housing 201; a cylindrical solenoid coil 202 accommodated inside the housing 201; and a movable iron core 203 disposed inside the solenoid coil 202.

Current flows through the solenoid coil 202 to generate an electromagnetic force that pulls the movable iron core 203 into the solenoid coil 202.

As shown in FIG. 5, when no electromagnetic force is generated in the solenoid coil 202, the movable iron core 203 protrudes from the solenoid coil 202. In this situation, the load on the arm 12 due to the spring 25 is small. In contrast, when the current flows through the solenoid coil 202 to generate the electromagnetic force as shown in FIG. 6, the movable iron core 203 is pulled into the solenoid coil 202, which is shown by arrow B in FIG. 6. Along with this, the arm main body 121 rotates in the direction shown by arrow A about the shaft 24, against the elastic force of the double torsion spring 25. As a result, the arm head 13 at the distal end of the arm main body 121 impacts the striking surface. In this situation, the load on the arm 12 due to the spring 25 is large. When the electromagnetic force of the solenoid coil 202 is turned off, the restoring force of the double torsion spring 25 causes the arm main body 121 to rotate in the direction reverse to the direction shown by arrow A about the shaft 24, and return to the position shown in FIG. 5. It should be noted that the position of the solenoid coil 202 and the arrangement of the spring 25 are one example, and can be appropriately changed.

As shown in FIG. 7, a control box 15 is disposed in at a position near the front side of the left-side surface of the cajon 100. The control box 15 is fixed to the holding portion

11*b* in the left side of the main body 11. The control box 15 accommodates an electronic circuit necessary for driving the arms 12. The electronic circuit is connected to the solenoid actuator 20 accommodated in each of the three arm supporters 14. The control box 15 is also connected to a power adapter 16 and the operation device 17. The operation device 17 includes four foot switches. Upon being pressed, the foot switches produce predetermined drive instruction signals to the electronic circuit. The electronic circuit previously stores data indicating a current-supply rhythm (a cycle, a current value, and so on of the current to be supplied to the solenoid coil 202 inside each of the arm supporters 14) for each of the foot switches. When the drive instruction signal from each of the foot switches is inputted into the electronic circuit, current is supplied individually to the solenoid coil 202 in the solenoid actuator 20 inside each of the arm supporters 14 attached to the main body 11, at the current-supply rhythm assigned to the foot switch.

Thus, with the current being supplied from the power adopter 16 to the control box (electronic circuit), one of the four foot switches is operated to repeatedly rotate the arm 12 in each of the arm supporters 14 at a predetermined cycle and intensity, causing the arm head 13 to swing toward the striking surface, and strike the striking surface of the cajon 100. Thus, sounds are emitted. Operating a different foot switch changes the rhythm at which the arm heads 13 strike the striking surface of the cajon 100. In other words, it is only required for a user to selectively press the foot switches in order to play the cajon 100.

In the aforementioned embodiment, the current supply rhythm for each of the foot switches is previously stored in the electronic circuit inside the control box 15. Here, the control box 15 may accommodate a communication circuit interactively communicable with an electronic terminal device 19, such as a personal computer or smartphone, so as to receive data relating to the current-supply rhythms from the electronic terminal devices through the communication circuit. A user may instruct the initiation and suspension of the current supply to the solenoid coil 202 through the electronic terminal devices 19, instead of operation of the foot switches, or may change the content of the current-supply rhythms stored in the electronic circuit.

Second Embodiment

The configuration of a percussion-instrument playing apparatus according to a second embodiment is described, with reference to FIGS. 8 to 13B. It should be noted that structural elements identical or correspond to those in the first embodiment are denoted by the numerals whose last two figures are the same with those in the first embodiment, and the description of those elements is appropriately omitted.

Figure 8:
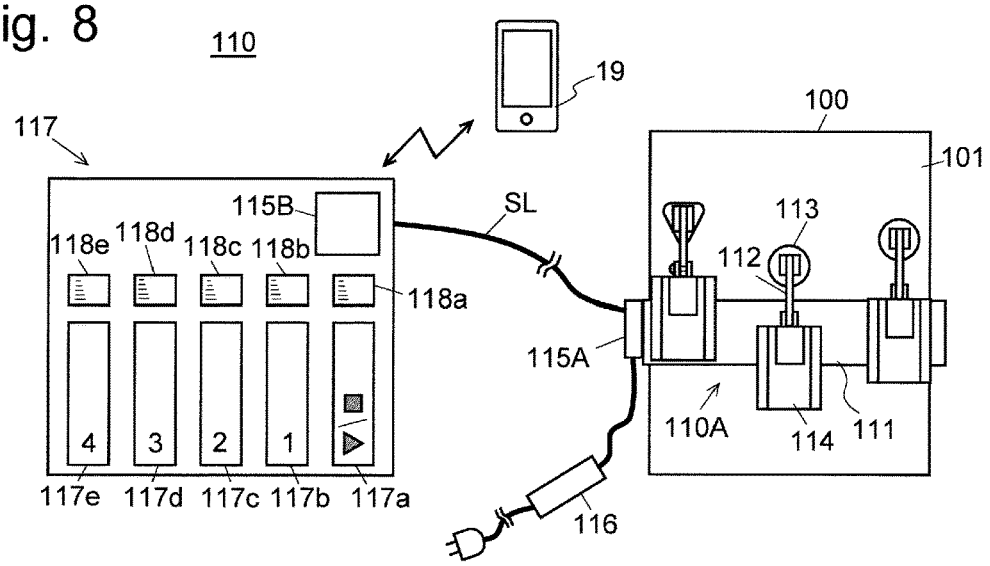
FIG. 8 is a schematic view of the entire structure of a percussion-instrument playing apparatus according to a second embodiment.

FIG. 8 shows the entire structure of a percussion-instrument playing apparatus 110 (hereinafter referred to as a "playing apparatus" 110) according to the present embodiment. As shown in FIG. 8, the playing apparatus 110 includes an apparatus main body 110A, a control device 115A, and an operation device 117. The operation device 117 includes five foot switches 117*a* to 117*e*, light emitting diode (LED) lamps 118*a* to 118*e* which turn on according to an operation of the foot switches, and a control board 115B. The foot switch 117*a* is used for instructing the initiation and suspension of a performance by the playing apparatus 110. The foot switches 117*b* to 117*e* are used for designating the data of a musical piece to be played by the playing apparatus 110. Details are described later.

Figure 9:
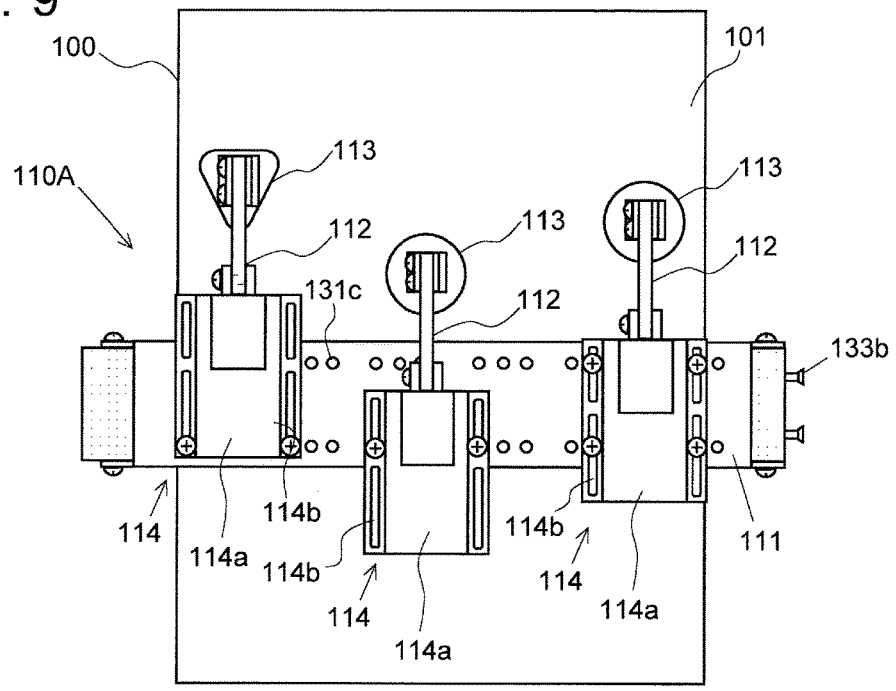
FIG. 9 is a front view of the apparatus main body attached to the cajon.

FIG. 9 is a front view of the apparatus main body 110A attached to the cajon 100. As shown in FIGS. 8 and 9, the apparatus main body 110A includes: a single main body 111; one or more arm supporters 114 fixed to the main body 111; as well as arms 112, arm heads 113 and other elements, each of which is attached to the corresponding one of the arm supporters 114. It should be noted that illustration of the control device 115A is omitted in FIG. 9.

Figure 10A:
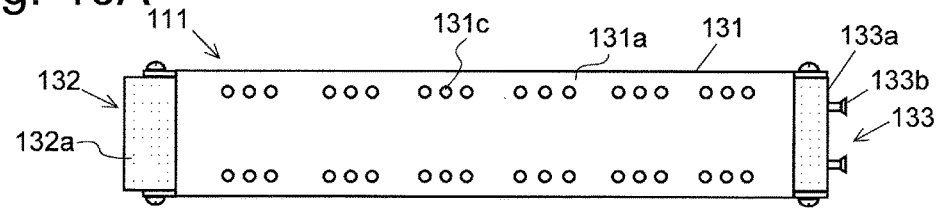
FIG. 10A is a front view of the apparatus main body.
Figure 10B:
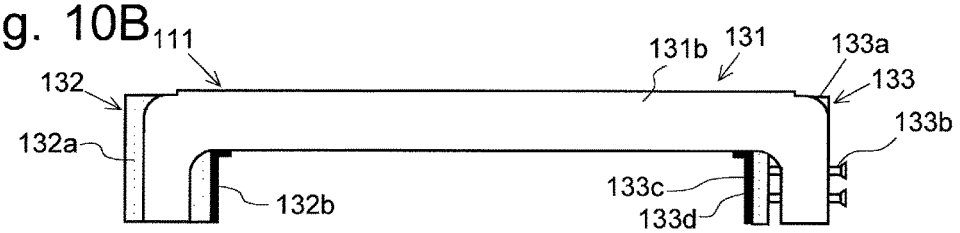
FIG. 10B is a bottom view of the apparatus main body.
Figure 10C:
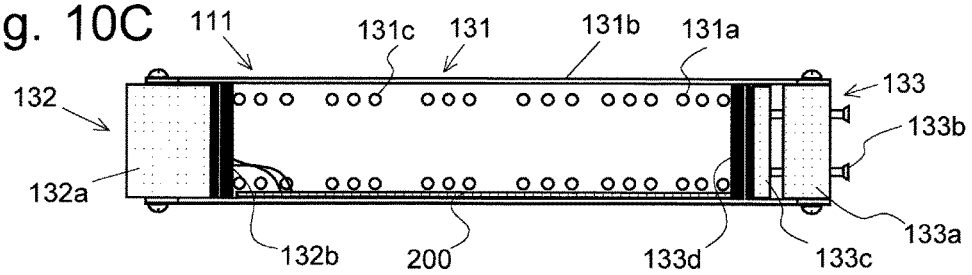
FIG. 10C is a rear view of the apparatus main body.
Figure 11:
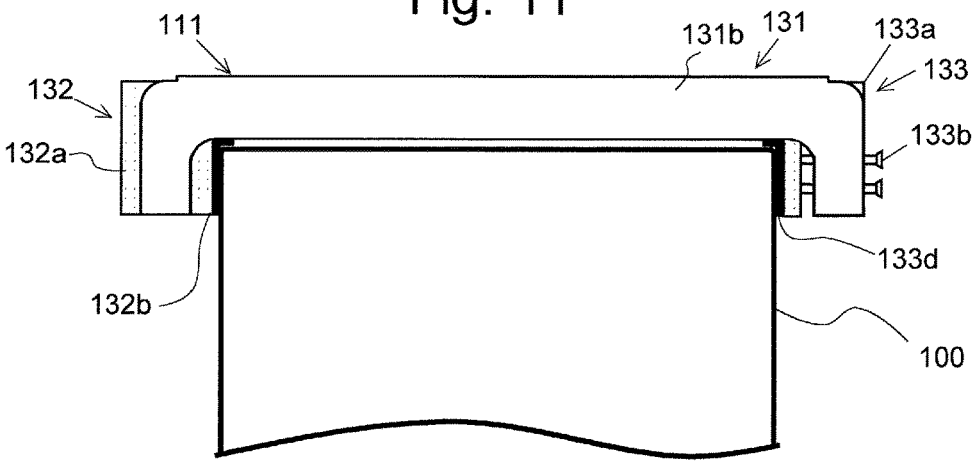
FIG. 11 is an explanatory diagram for a positional relationship between the apparatus main body and a striking surface of the cajon.

As shown in FIGS. 10A to 10C, the main body 111 includes a U-shaped metal frame 131, with the holding portions 132 and 133 individually attached to the opposite ends of the frame 131. The frame 131 includes a plate portion 131*a* and U-shaped portions 131*b* respectively disposed on the upside and downside of the plate member 131*a*. The plate member 131*a* faces the striking surface in a manner of being approximately parallel to the same surface, when the main body 111 is mounted on the cajon 100. The frame 131 is made from a single metal plate by bending work to form the plate portion 131*a* and the U-shaped portions 131*b*. The inside of the frame 131 is empty. The plate portion 131*a* is provided with a plurality of holes 131*c* for receiving the arm supporters 114. In the present embodiment, the holes 131*c* function as the supporter attachment portions.

The holding portions 132 and 133 are individually attached to the opposite ends of the frame 131. One of the holding portions 132 includes a plastic block 132*a* that is screwed to the frame 131, and a rubber sheet 132*b* that is stuck on the block 132*a*. The other holding portion 133 includes a plastic block 133*a* that is screwed to the frame 131, a movable plastic plate 133*c* connected to the block 133*a* via two bolts 133*b*, and a rubber sheet 133*d* that is stuck on the movable plate 133*c*. The sheet 132*b* and the sheet 133*d* are respectively stuck on the block 132*a* and the movable plate 133*c* in a manner of facing each other.

A tape-shaped light emitting member 200 is stuck on the reverse side of the U-shaped portion 131*b* of the frame 131 inside the main body 111. The light emitting member 200 includes many LEDs mounted on a sheet member.

The main body 111 is mounted on the cajon 100 as follows. First, the sheet 132*b* of the holding portion 132 and the sheet 133*d* of the holding portion 133 are faced toward the cajon 100. The plate part 131*a* is disposed in front of the striking surface (front surface) of the cajon 100 so as to be in parallel to the striking surface. The main body 111 is moved closer to the striking surface of the cajon 100. The sheets 132*b* and 133*d* of the respective holding portions 132 and 133 are put on the left and right sides of the striking surface of the cajon 100. Here, each of the ends of the sheets 132*b* and 133*d* in the side close to the plate portion 131*a* partially protrudes between the striking surface of the cajon 100 and the frame 131. Accordingly, when the main body 111 is fully brought close to the cajon, a gap corresponding to the thickness of each of the sheets 132*b* and 133*d* (about 1 to 2 mm) is always left between the main body 111 and the striking surface of the cajon 100 (see FIG. 11). If a space exists between each of the sheets 132*b* and 133*d* and each of the left and right sides of the cajon 100, the bolts 133*b* are screwed to drive the movable plate 133*c* toward the block 132*a* of the holding portion 132. With this, the cajon 100 is firmly clamped by the block 132*a* and the movable plate 133*c*, whereby the main body 111 is fixed to the cajon 100. The main body 111 can be removed from the cajon 100 by screwing the bolts 133*b* in the reverse direction. As mentioned above, the blocks 132*a* and 133*a*, movable plate 133*c*, bolts 133*b*, and other elements constitute the attachment portion in the present embodiment.

Figure 12A:
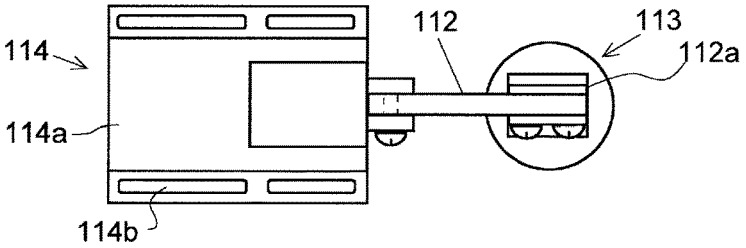
FIG. 12A is a front view of the arm supporter and the arm.
Figure 12B:
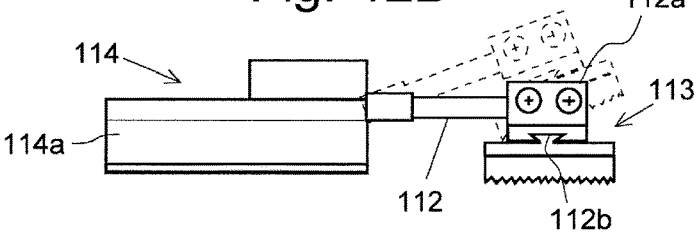
FIG. 12B is a side view of the arm supporter and the arm.
Figure 13A:
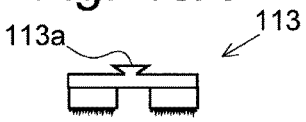
FIG. 13A is a side view of an arm head.
Figure 13B:
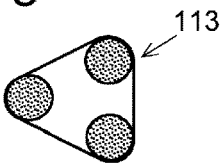
FIG. 13B is a rear view of the arm head.

As shown in FIGS. 12A and 12B, the arm supporter 114 includes an accommodation portion 114*a*, and long holes 114*b* used for fixing the arm supporter 114 to the holes 131*c* of the plate portion 131*a* with screws. The number of the long holes 114*b* is four, for example. The accommodation portion 114*a* accommodates a solenoid actuator, a joint for transmitting the movement of the solenoid actuator to the arm 122, and others. Connecting structures and the like between the solenoid actuator and the joint, and between the joint and the arm 122 are the same as those in the first embodiment, so that illustration and description of those elements are omitted.

The four long holes 114*b* of the arm supporter 114 are put to any of holes 131*c* of the plate portion 131*a*, and screws are threaded through those holes to attach the arm supporter 114 to the plate portion 131*a*. The position of the arm supporter 114 in the horizontal direction with respect to the plate portion 131*a* is determined by the position of the holes 131*c* which the long holes 114*b* are put on. The position of the arm supporter 114 in the vertical direction with respect to the plate portion 131*a* is determined by the position of the long holes 114*b* which the screws are inserted into. With such a configuration, the attachment position of the arm supporter 114 with respect to the plate portion 131*a* can be appropriately changed in each of the horizontal and vertical directions.

The arm 112 has the distal end to which a head-attachment member 112*a* is fixed. In the head-attachment member 112*a*, a dovetail groove 112*b* is formed. The arm head 113 has a protrusion 113*a* to be engaged in the dovetail groove 112*b*. Accordingly, the arm head 113 can be detachably attached to the head-attachment member 112*a*. The arm head 113 shown in FIGS. 12A and 12B has a circular substrate and a circular pad that has approximately the same diameter as the circular substrate and is attached to the circular substrate. The arm head 113 shown in FIGS. 13A and 13B has a triangular substrate and three circular pads that are individually attached to the three corners of the triangular substrate. A plurality of arm heads 113 which vary in the shape of the part for pushing the striking surface and/or in the material of the pad can be prepared and selectively attached to the arm depending on the type of the musical piece to be performed, whereby the variations of the performance can be widened. In addition, a deteriorated arm head 113 can be easily replaced.

As shown in FIG. 8, the control box 115A in which an electronic circuit is accommodated is attached to the left side of the main body 111. A power adapter 116 and an operation device 117 are connected to this control box 115A.

Figure 14:
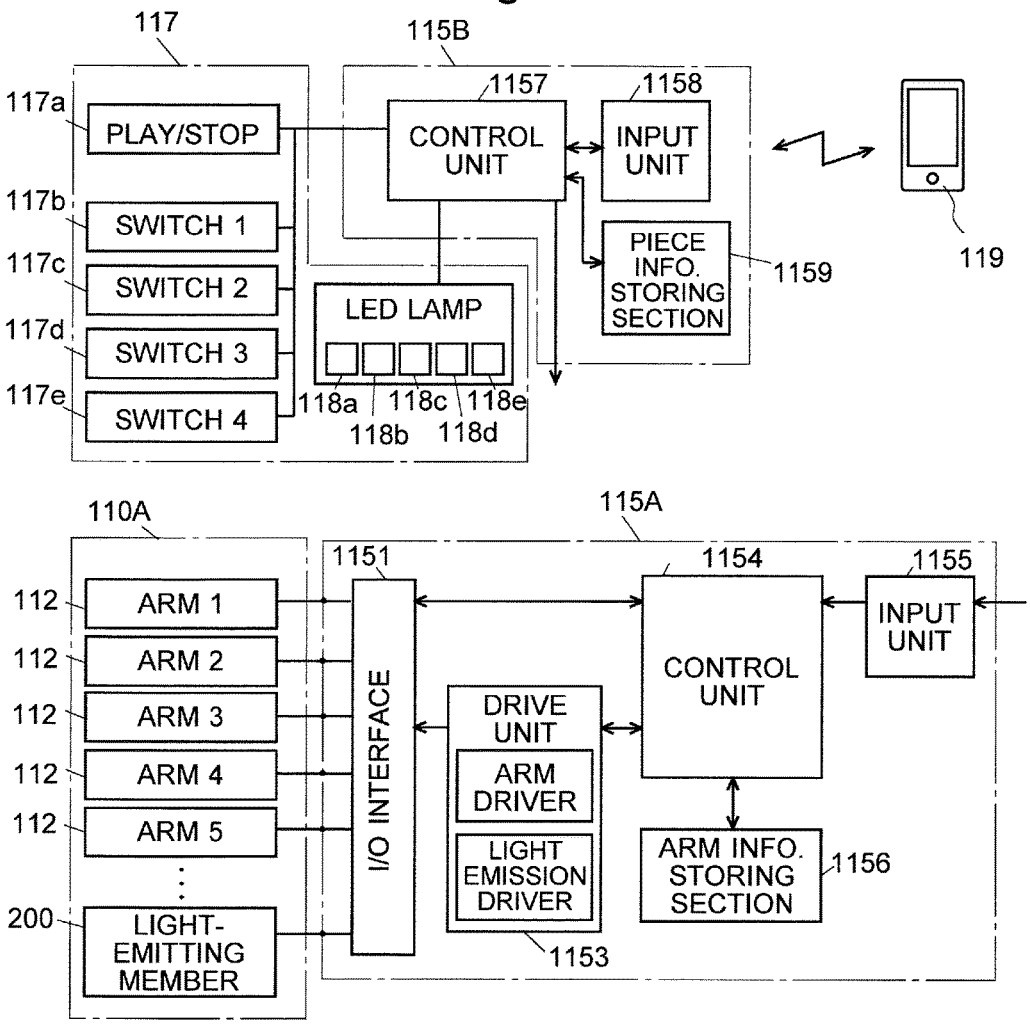
FIG. 14 is a functional block diagram showing the percussion-instrument playing apparatus according to the second embodiment.

FIG. 14 is a functional block diagram showing the playing apparatus 110 according to the present embodiment. As shown in this drawing, the electronic circuit inside the control box 115A includes an input/output (I/O) interface 1151, an arm detector 1152, a drive unit 1153 having an arm driver and a light-emission driver, a control unit 1154, an input unit 1155, and an arm-information storing section 1156. The control board 115B includes a control unit 1157, an input unit 1158, and a piece-information storing section 1159.

The piece-information storing section 1159 of the control board 115B stores data of musical pieces. The data of the musical piece includes, for example, data according to the MIDI specification, but is not limited thereto. The data of the musical piece contains data relating to a time period from the beginning of the performance, beats, rhythm patterns, and the like.

The input unit 1158 is used for inputting data of the musical piece to be stored in the piece-information storing section 1159 through an external device 119, such as a smartphone or a personal computer. In the external device 119, data of the musical piece acquired through the Internet and data of the musical piece composed in the external device 119 are stored, and those data are used. The external device 119 is operated to rewrite, through the input unit 1158, contents of the data of the musical piece stored in the piece-information section unit 1159, or to set four pieces of music data to be individually allocated to the four foot switches 117*b* to 117*e*. There is no necessity to allocate different pieces of music data to the four foot switches 117*b* to 117*e*. The same piece of music data may be allocated to two or more foot switches. Furthermore, there is no necessity to allocate data to every one of the four foot switches. There may be a foot switch to which no data of the musical piece is allocated.

The main body 111 includes a plurality of connection terminals (not shown) for the arm supporters 114. The I/O interface 1151 is used for controlling the input and output of signals between the control box 115A and the light emitting member 200 as well as between the control box 115A and each of the solenoid actuators in the arm supporters 114 connected to the connection terminals.

The arm-information storing section 1156 stores the information relating to the rotational displacement characteristics of the arm 112 (arm information) included in the arm supporter 114 attached to the main body 111. The arm information contains, for example: type of the arm 112; intensity at which the arm head 113 strikes a striking surface (sound volume); and information relating to the drive control of the solenoid actuator. The information of the drive control of the solenoid actuator is set based on the weight and length of each type of the arm 112, the elasticity of the double torsion spring 25 (see FIGS. 4 to 6), the size of the solenoid actuator 20 (see FIGS. 4 to 6), and other factors. Details are described later.

The input unit 1155 is used for inputting, into the control unit 1154, data sent from the control board 115B through a signal line SL. The data sent from the control board 115B includes the data of the musical piece stored in the piece-information storing section 1159, and the arm information inputted into the control board 115B through the input unit 1158 from the external device 119, such as a smartphone or a personal computer. In other words, the arm information stored in the arm-information storing section 1156 is input from the external device 119 through the control board 115B. Furthermore, by operating the external device 119, users can also rewrite, directly or via the control board 115B, the content of the arm information stored in the arm-information storing section 1156.

Accordingly, the external device 119 previously stores the arm information of a plurality of types of arms attachable to the main body 111. The external device 119 stores the arm information acquired through the Internet, or the arm information prepared in the external device 119. The user operates the external device 119 to select, among a plurality of pieces of the arm information, the arm information of the arm 112 included in the arm supporter 114 that is attached to one of the connection terminals of the main body 111, and sends the selected information. The control unit 1157 of the control board 115B receives the arm information sent from the external device 119 through the input unit 1158, and sends the received information to the control box 115A. The control unit 1154 in the control box 115A receives the arm information through the input unit 1155, and store the arm information in the arm-information storing section 1156. The arm-information storing section 1156 includes storage areas individually corresponding to each of the connection terminals of the main body 111. The received arm information is stored in the corresponding one of the storing areas.

Next, a specific operation of the playing apparatus 110 in playing the cajon 100 is described.

First, upon an operation of the foot switch 117*a* that instructs "play and stop" when the playing apparatus 110 is not playing the cajon 100, the control unit 1157 reads data of the musical piece allocated to the foot switch 117*b* (switch 1) out from the piece-information storing section 1159, and sends it to the control box 115A. At this time, the control unit 1157 causes LED lamps 118*a* and 118*b* respectively corresponding to the foot switches 117*a* and 117*b* to be lit.

Upon receiving the data of the musical piece sent from the control board 115B through the input unit 1155, the control unit 1154 causes the drive unit 1153 to drive the solenoid actuator of each of the arms 112, based on the data of the musical piece and the arm information read from the arm-information storing section 1156. With this, each of the arms 112 of the corresponding one of the arm supporters 114 (in the example of FIG. 9, three arm supporters 114) attached to the main body 111 rotates with appropriate rhythm, so that the arm heads 113 strike the striking surface of the cajon 100.

The control unit 1154 also controls the drive unit 1153 based on the data of the musical piece so as to drive the LEDs of the light emitting member 200 to emit light, for example, in accordance with striking timings that the arm heads 113 strike the striking surface 101 of the cajon 100.

Upon an operation of the foot switch 117*a* that instructs "play and stop" when the playing apparatus 110 is playing the cajon 100, the performance is stopped. Upon an operation of a foot switch (switches 2 to 4) other than the foot switch (switch 1) to which the data of the musical piece being played by the playing apparatus 110 is allocated, the control unit 1157 reads the data allocated to the operated foot switch out of the piece-information storing section 1159, and sends it to the control box 115A. With this, the control unit 1154 controls the drive unit 1153 in accordance with the newly received data of the musical piece, to drive the solenoid actuator. With this, the arms 112 rotate with rhythms different from those used up to that time, so that the arm heads 113 also strike the striking surface 101 of the cajon 100 with the new rhythms. In this manner, the playing apparatus 110 repeats the performances in accordance with any data of the musical piece selected from the four pieces of data. The control unit 1154 may immediately switch, upon receiving the new data, from the control in accordance with the previous data to another control in accordance with the new data. However, it is preferable to perform this switching operation at an appropriate timing (at a break between the playing loops, for example).

Figure 15:
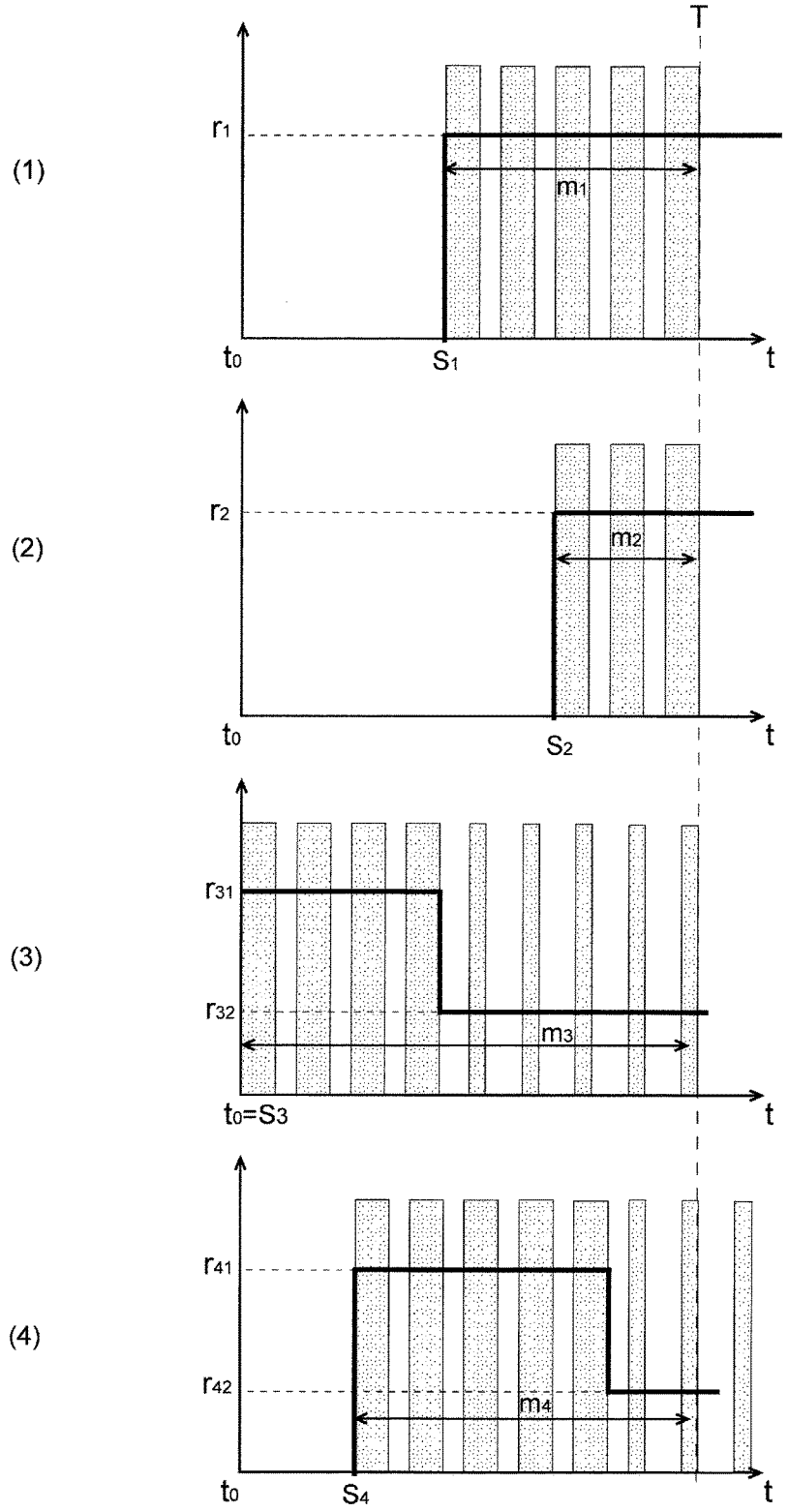
FIG. 15 is an explanatory diagram for difference in the driving control by the solenoid actuator, depending on the difference in the weight of the arm and in sound volume.

Here, the description is given to the drive control on the solenoid actuator based on an arm weight that is one of the arm information and the data of the musical piece, with reference to FIG. 15. In the present embodiment, the control unit 1154 adopts a Pulse-Width Modulation (PWM) control for controlling the drive unit 1153, so as to drive the solenoid actuator. A weight of the arm is determined by the material, length of the arm, and type of the arm head.

In each of the charts shown in FIGS. 15(1) to 15(4), the horizontal axis indicates time, whereas the vertical axis indicates a voltage value. In every chart, rectangular figures indicate driving pulses; bold solid lines indicate effective voltages; T indicates the time at which a sound is emitted; t0 indicates the time at which data of the musical piece is inputted; S1 to S4 individually indicate the time at which the driving of the solenoid actuator initiates; m1 to m4 individually indicate time periods from the initiation of driving of the solenoid actuator to the emission of the sound; r1, r2, r31, r32, r41, and r42 individually indicate the effective voltage values.

FIG. 15(1) shows a control pattern when the striking surface is struck loudly by using a heavy arm. FIG. 15(2) shows a control pattern when the striking surface is struck loudly by using a light arm. As compared to the light arm, the heavy arm is slower to follow the driving force and requires an accordingly longer period of time to reach the position where the arm head comes in contact with the striking surface after the arm begins its rotation upon supply of the current to the solenoid coil. In other words, it takes time from the initiation of driving the solenoid actuator to the striking of the striking surface by the arm head (until sound emission) (m1>m2). In view of this, the time period from the reception of the data of the musical piece to the initiation of the driving is shortened (S1<S2).

FIG. 15(3) shows a control pattern when the striking surface is struck at a low sound by using a heavy arm. FIG. 15(4) shows a control pattern when the striking surface is struck with a low sound volume by using a light arm. When the striking surface is struck with a low sound volume, the time period from the reception of the data of the musical piece to the initiation of the driving is made shorter (S3<S4) for the heavy arm than for the light arm, similar to the case when the striking surface is struck loudly. Here, when the performance is played with a low sound volume, the intensity at which the arm strikes the striking surface should be decreased. This is achieved as follows: The effective voltage value is initially secured at a necessary level for initiating the motion of the arm until the lapse of a predetermined time from the beginning of the driving. Then, the duty cycle of the pulses is reduced to decrease the effective voltage.

The control pattern of the solenoid actuator may also be changed according to the length of the arm 112 in place of the weight of the arm 112 as the previously described example. The control pattern of the solenoid actuator may also be changed according to both the weight and the length of the arm 112.

As mentioned above, the driving of the solenoid actuator can be controlled according to the weight of the arm to decrease the time lag between the timing of striking the striking surface 101 of the cajon 100 by the arm head 133, which is indicated by the data of the musical piece, and the timing of the actual striking of the striking surface 101 by the arm head 113.

It should be noted that the present invention is not limited to the above mentioned examples, and can be appropriately changed, as described below.

<Modified Example of the Light Emitting Device>

Figure 16A:
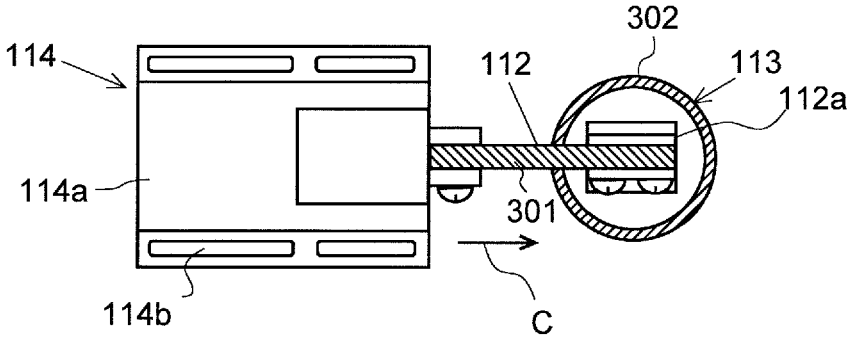
FIG. 16A is a front view of a modified example of a light emitting device.
Figure 16B:
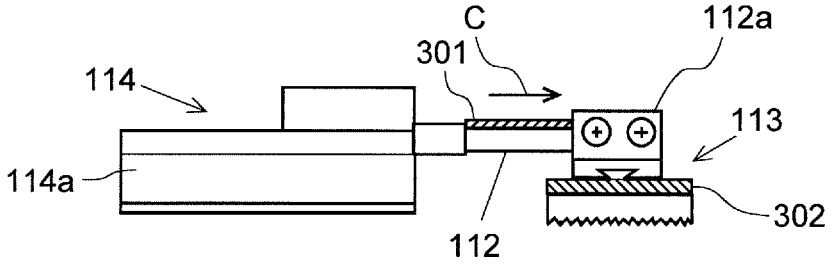
FIG. 16B is a side view of the modified example of the light emitting device.

FIGS. 16A and 16B show an example in which a tape-shaped LED 301 is stuck along the arm 112, and a tape-shaped LED 302 is stuck around the arm head 113. For this case, LEDs 301 and 302 may be controlled to emit light in accordance with the timing at which the striking surface is struck by the arm head 113. In addition, LEDs 301 may be controlled to light successively in the direction indicated by arrow C or the direction reverse to the direction indicated by arrow C, depending on the rotary direction of the arm 112.

<Modified Example of the Arm Supporter>

Figure 17:
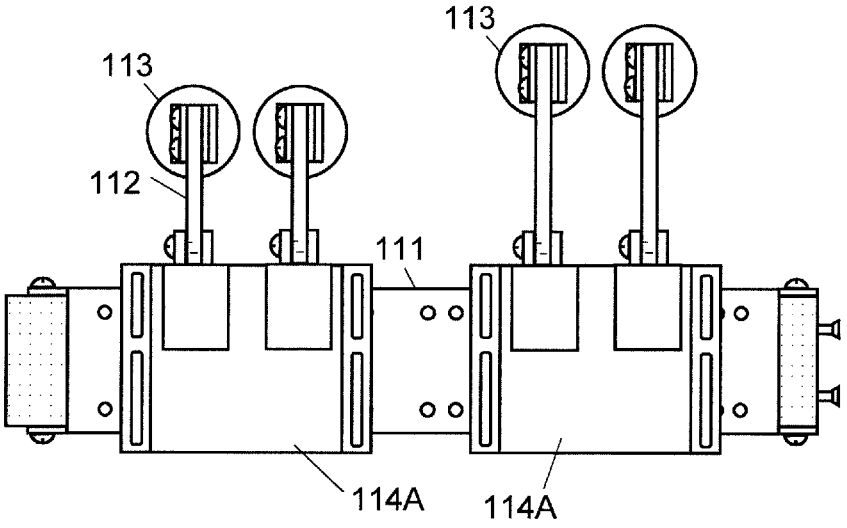
FIG. 17 is a diagram showing a modified example of the arm supporter.

FIG. 17 shows an example in which two arm supporters 114A each including two arms 112 are attached to the main body 111.

Figure 18:
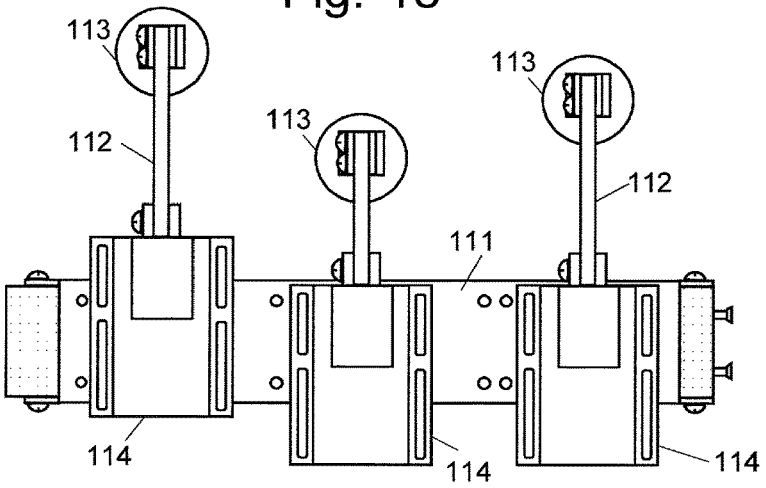
FIG. 18 is a diagram showing another modified example of the arm supporter.

FIG. 18 shows an example in which three arm supporters 114A each including a single arm having a different length are attached to the main body 111.

Figure 19:
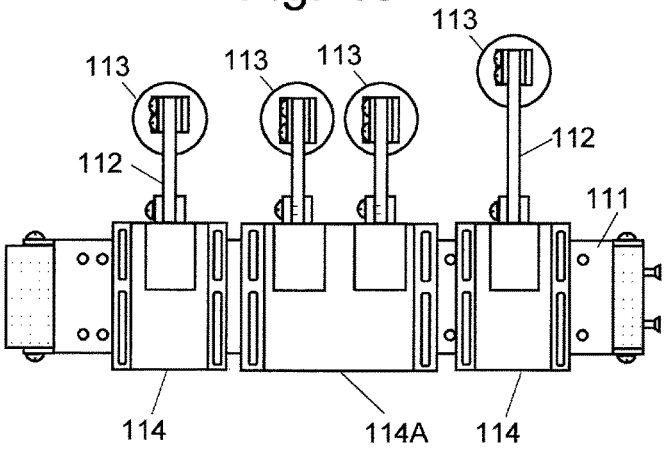
FIG. 19 is a diagram showing still another modified example of the arm supporter.

FIG. 19 shows an example in which a single arm supporter 114A including two arms 112, and two arm supporters 114 each including a single arm are attached to the main body 111.

The arm supporters 114A shown in FIGS. 17 and 19 include a drive device (not shown) for driving two arms 112. The drive device may include a single drive unit (solenoid actuator, for example) to drive two arms 112 together. Alternatively, the drive device may include two drive units each of which drives one of the arms 112.

Figure 20:
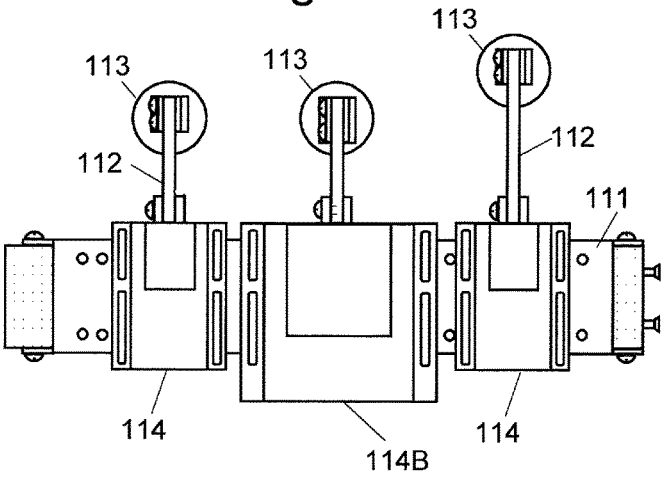
FIG. 20 is a diagram showing even still another modified example of the arm supporter.

FIG. 20 shows an example in which three arm supporters are attached to the main body 111. Among the three arm supporters, a central arm supporter 114B is larger in size than the left and right arm supporters 114, and supports the arm 112 having the arm head 113 that is heavier than the arm heads of the arm supporters 114. In addition, the arm supporter 114B includes a drive device (not shown) that is larger in size and higher in power than the drive devices included in the arm supporters 114. This configuration provides a wider variety of the combinations of the intensity at which the arm heads 113 of the arm supporters 114B and 114 strike the striking surface. In addition, an arm having a heavier arm head than those of the arms included in the arm supporters 114 can be used.

<Modified Example of an Attaching Manner of the Arm Supporter to the Main Body>

Figure 21:
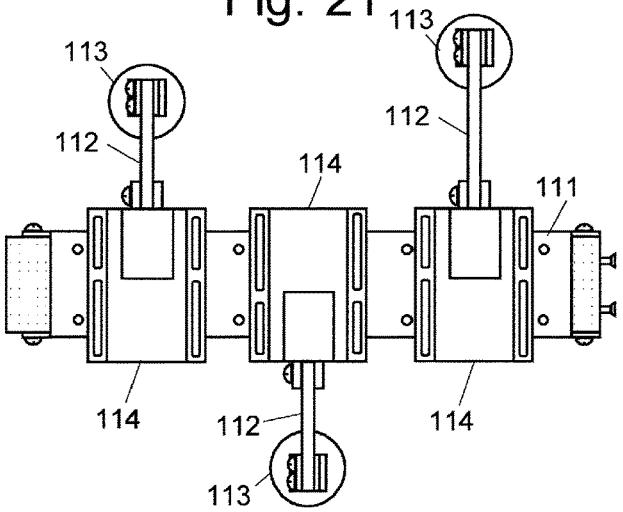
FIG. 21 is a diagram showing a modified example of a manner of attaching the arm supporter to the apparatus main body.
Figure 22:
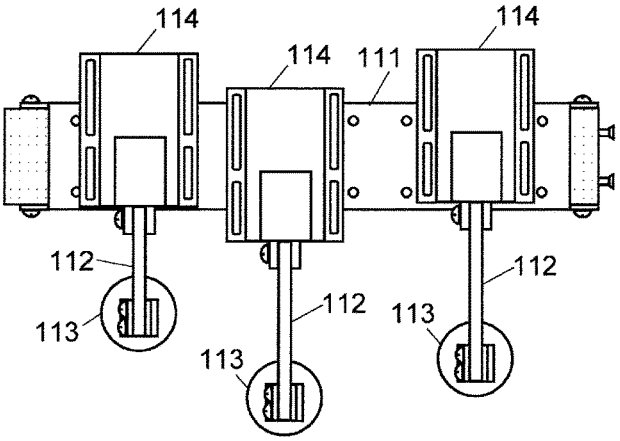
FIG. 22 is a diagram showing another modified example of the manner of attaching the arm supporter to the apparatus main body.

FIGS. 21 and 22 show examples in which three arm supporters 114 each including a single arm are attached to the main body 111. In FIG. 21, two of the three arm supporters 114 are attached to the main body 111 in such a manner that the arms 112 face upward, and the remaining one arm supporter 114 is attached to the main body 111 in such a manner that the arm 112 faces downward. In FIG. 22, all of the three arm supporter 114 attached to the main body 111 have their respective arms 112 directed downward.

It should be noted that each of the configurations shown in FIGS. 17 to 22 is merely an example. Appropriate changes can be made to the kind of arm supporter to be attached to the main body 111 or the direction in which the attached arm supporter should face. The number and the combination of the arm supporters to be attached to the main body 111 can also be appropriately changed. The number of the arm supporters attached to the main body is not limited to two or more, but may be one.

<Modified Example of the Operation Device>

Figure 23:
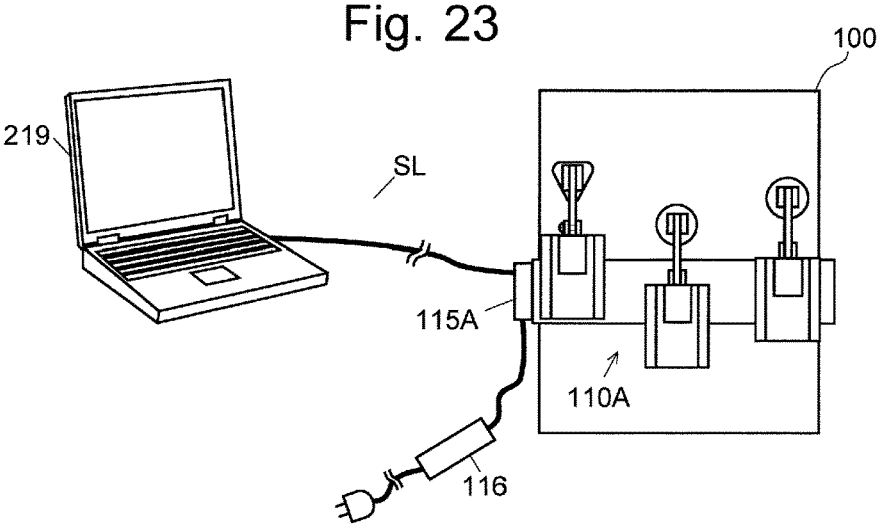
FIG. 23 is a diagram showing a modified example of an operation device.

FIG. 23 shows an example in which a personal computer 219 as the external device is also used as the operation device. In this configuration, the personal computer 219 is operated in place of the foot switches to issue commands for the initiation, halting and other operations of the driving of the apparatus main body 110A and the arm 112.

<Modified Example of Driving Control of the Arm>

In the above-mentioned second embodiment, a user manually inputs the arm information according to the type of the arm supporters 114 attached to the main body 111 through the external device 119. Alternatively, an identifier may be attached to the arm supporter 114, and the control unit 1154 may read the identifier of the arm supporter 114 when the arm supporter 114 is attached to the frame 131 of the main body 111. The control unit 1154 reads the arm information corresponding to the identifier from the arm-information storing section 1156, to control the drive unit 1153 with an appropriate protocol based on the arm information so as to drive the solenoid actuator.

Other Modified Examples

The operation device may recognize the voice emitted by a user and output a drive instruction signal. In this configuration, the emission of the voice by the user corresponds to the "operation by a user".

Although the control unit 1154 drives the solenoid actuator in accordance with data of the musical piece previously stored in the piece-information storing section 1159 in the aforementioned second embodiment, a music-piece data creating device may connect to the control device, and the control device may control the drive device in accordance with the data created by the music-piece data creating device. In this example, it may be preferable that the music-piece data creating device, for example, automatically creates data of the musical piece suitable for rhythms performed by an instrument other than the percussion instrument for which the percussion-instrument playing apparatus is used.

INDUSTRIAL APPLICABILITY

The present invention can be used for playing a percussion instrument that emits sounds by being struck on its striking surface.

REFERENCE SIGNS LIST

100 . . . Percussion Instrument (Cajon)
10, 110 . . . Percussion-Instrument Playing Apparatus
10A, 110A . . . Apparatus Main Body
11, 111 . . . Main Body
  11*a* . . . Arm Attachment Plate
  11*b*, 11*c* . . . Holding Portion
12, 112 . . . Arm
  121 . . . Arm Main Body
  122 . . . Proximal End
13, 113 . . . Arm Head
14, 114 . . . Arm Supporter
15, 115A . . . Control Box
115B . . . Control Panel
  1154, 1157 . . . Control Unit
  1155, 1158 . . . Input Unit
16, 116 . . . Power Source Adopter
17, 117 . . . Operation Device
  117*a*-117*e* . . . Foot Switch
18 . . . Floor
19 . . . Electronic Terminal Device
20 . . . Solenoid Actuator
  201 . . . Housing
  202 . . . Solenoid Coil
24 . . . Shaft
25 . . . Double Torsion Spring
26 . . . Joint

The invention claimed is:

1. A percussion-instrument playing apparatus comprising:

a main body to be detachably fixed in front of or above a percussion instrument having, in a front surface or an upper surface, a striking surface, the main body including two fixing portions to be detachably fixed to both sides of the striking surface of the percussion instrument and an arm attachment member that bridges a space between the two fixing portions, and the arm attachment member facing the striking surface with a predetermined space from the striking surface when the two fixing portions are respectively fixed to both sides of the striking surface of the percussion instrument;

an arm supporter fixed to the arm attachment member;

one or more arms each having one end fixed to the arm supporter;

an arm head detachably fixed to the other end of the arm; and a drive unit for driving the one or more arms under electronic control, wherein the arm head of each of the one or more arms strikes the same striking surface of the percussion instrument to cause sounds to be emitted from the percussion instrument.

2. A percussion-instrument playing apparatus for playing a percussion instrument having a striking surface, comprising:

a) a main body including an arm attachment member, the main body configured to be mounted on an outside of the percussion instrument in such a manner that the arm attachment member faces the striking surface of the percussion instrument with a predetermined space from the striking surface;

b) an arm supporter attached to the arm attachment member;

c) an arm that has, at a distal end, an arm head, and is rotatably supported by the arm supporter;

d) a drive device that allows the arm to be rotationally displaced and alternately switched between a state where the arm head pushes the striking surface and a state where the arm head is separated from the striking surface, when the main body is mounted on the percussion instrument;

e) a control device that controls the drive device in accordance with a control program; and f) an operation device that outputs a drive instruction signal to the control device in response to an operation by a user.

3. The percussion-instrument playing apparatus according to claim 2, wherein:

each of the arm attachment member and the arm supporter includes an attachment portion for attaching the arm supporter to the arm attachment member; and at least one of the attachment portion of the arm attachment member and the attachment portion of the arm supporter is configured so that a position at which the arm supporter is attached to the main body is changeable.

4. The percussion-instrument playing apparatus according to claim 2, wherein the arm attachment member includes a plurality of supporter attachment portions for attaching the arm supporter.

5. The percussion-instrument playing apparatus according to claim 4, wherein the drive device includes a plurality of drive units that independently drive the arm of the arm supporter attached to each of the supporter attachment portions.

6. The percussion-instrument playing apparatus according to claim 2, wherein at least one of the main body, the arm, and the arm head includes a light emitting device that repeats turning lights on and off in response to a timing the arm head pushes the striking surface.

7. The percussion-instrument playing apparatus according to claim 2, further comprising an adjusting member that adjusts intensity at which the arm head strikes the striking surface.

8. The percussion-instrument playing apparatus according to claim 2, further comprising:

a plurality of types of arm supporters to be detachably attached to the arm attachment member, each of the plurality of types of the arm supporters supporting the arm having, at the distal end, the arm head with individual weight; and an arm-information storing section for storing arm information relating to rotational displacement characteristics of the arm supported by a corresponding one of the arm supporters, for the plurality of types of the arm supporters, wherein the control device controls the drive device in accordance with the control program and the arm information for each of the arms supported by the corresponding arm supporters attached to the main body.

9. The percussion-instrument playing apparatus according to claim 2, wherein:

the main body includes a pair of holding portions to be attached to both side portions of the striking surface of the percussion instrument in such a manner as to hold the striking surface from both sides; and the arm attachment member bridges a space between the pair of the holding portions.

10. The percussion-instrument playing apparatus according to claim 1, wherein the percussion instrument is a cajon.

11. The percussion-instrument playing apparatus according to claim 2, wherein the percussion instrument is a cajon.

12. The percussion-instrument playing apparatus according to claim 3, wherein the arm attachment member includes a plurality of supporter attachment portions for attaching the arm supporter.

13. The percussion-instrument playing apparatus according to claim 12, wherein the drive device includes a plurality of drive units that independently drive the arm of the arm supporter attached to each of the supporter attachment portions.

14. The percussion-instrument playing apparatus according to claim 3, wherein at least one of the main body, the arm, and the arm head includes a light emitting device that repeats turning lights on and off in response to a timing the arm head pushes the striking surface.

15. The percussion-instrument playing apparatus according to claim 3, further comprising an adjusting member that adjusts intensity at which the arm head strikes the striking surface.

16. The percussion-instrument playing apparatus according to claim 3, further comprising:

a plurality of types of arm supporters to be detachably attached to the arm attachment member, each of the plurality of types of the arm supporters supporting the arm having, at the distal end, the arm head with individual weight; and an arm-information storing section for storing arm information relating to rotational displacement characteristics of the arm supported by a corresponding one of the arm supporters, for the plurality of types of the arm supporters, wherein the control device controls the drive device in accordance with the control program and the arm information for each of the arms supported by the corresponding arm supporters attached to the main body.

17. The percussion-instrument playing apparatus according to claim 3, wherein:

the main body includes a pair of holding portions to be attached to both side portions of the striking surface of the percussion instrument in such a manner as to hold the striking surface from both sides; and the arm attachment member bridges a space between the pair of the holding portions.

* * * * *